US011504988B2

(12) United States Patent
Oguchi et al.

(10) Patent No.: US 11,504,988 B2
(45) Date of Patent: Nov. 22, 2022

(54) SHEET CASSETTE AND PRINTING SYSTEM

(71) Applicant: FUJITSU COMPONENT LIMITED, Tokyo (JP)

(72) Inventors: Tatsuya Oguchi, Tokyo (JP); Sumio Watanabe, Tokyo (JP); Yukihiro Mori, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 687 days.

(21) Appl. No.: 16/354,494

(22) Filed: Mar. 15, 2019

(65) Prior Publication Data

US 2019/0291482 A1 Sep. 26, 2019

(30) Foreign Application Priority Data

Mar. 23, 2018 (JP) ..... JP2018-055906

(51) Int. Cl.

| | |
|---|---|
| ***B41J 15/04*** | (2006.01) |
| ***B41J 3/36*** | (2006.01) |
| ***B41J 29/393*** | (2006.01) |
| ***B65H 1/26*** | (2006.01) |
| ***B41J 13/10*** | (2006.01) |

(52) U.S. Cl.

CPC ..... *B41J 15/044* (2013.01); *B41J 3/36* (2013.01); *B41J 13/103* (2013.01); *B41J 29/393* (2013.01); *B65H 1/266* (2013.01); *B65H 2402/41* (2013.01); *B65H 2405/313* (2013.01)

(58) Field of Classification Search

CPC . B41J 15/044; B41J 3/36; B41J 13/103; B41J 29/393; B65H 1/266; B65H 2402/41; B65H 2405/313

See application file for complete search history.

(56) References Cited

U.S. PATENT DOCUMENTS

| | | | | |
|---|---|---|---|---|
| 3,748,984 | A | 7/1973 | Gold | |
| 5,569,156 | A * | 10/1996 | Mussivand | A61M 60/432 600/16 |
| 5,850,243 | A | 12/1998 | Kinoshita et al. | |
| 6,270,271 | B1 | 8/2001 | Fujiwara | |
| 6,317,156 | B1 * | 11/2001 | Nagasaki | B41J 3/445 348/207.1 |
| 10,737,514 | B2 * | 8/2020 | Oguchi | B65H 1/04 |
| 2007/0061508 | A1 * | 3/2007 | Zweighaft | G11B 15/04 711/111 |
| 2008/0218901 | A1 * | 9/2008 | Haustein | G11B 23/107 360/90 |

(Continued)

FOREIGN PATENT DOCUMENTS

| | | |
|---|---|---|
| JP | S61-127529 | 6/1986 |
| JP | H11-138911 | 5/1999 |

(Continued)

*Primary Examiner* — David H Banh

(74) *Attorney, Agent, or Firm* — IPUSA, PLLC

(57) ABSTRACT

A sheet cassette configured to store a recording sheet and connectable to a printer includes a battery, a storage, a communication terminal, and an electrode terminal. The storage is configured to store information. The sheet cassette is configured to perform communications between the sheet cassette and the printer through the communication terminal. The sheet cassette is configured to supply the electric power of the battery to the printer through the electrode terminal.

7 Claims, 16 Drawing Sheets

(56) References Cited

U.S. PATENT DOCUMENTS

| | | | | |
|---|---|---|---|---|
| 2009/0292918 | A1* | 11/2009 | Mori | H04L 9/0894 713/168 |
| 2012/0243927 | A1* | 9/2012 | Takayama | B41J 3/4075 400/582 |
| 2014/0240438 | A1* | 8/2014 | Furuyama | H01M 50/20 347/222 |
| 2017/0106679 | A1* | 4/2017 | Sakano | B41J 2/32 |
| 2017/0225490 | A1* | 8/2017 | Kubota | B41J 3/36 |
| 2017/0230540 | A1* | 8/2017 | Sasaki | H04N 1/4426 |
| 2017/0313058 | A1* | 11/2017 | Fricke | B41J 2/04541 |
| 2018/0232619 | A1* | 8/2018 | Kagawa | G06K 19/06028 |

FOREIGN PATENT DOCUMENTS

| | | |
|---|---|---|
| JP | 2002-361897 | 12/2002 |
| JP | 2004-160701 | 6/2004 |
| JP | 2004-345819 | 12/2004 |
| JP | 2005-35180 | 2/2005 |
| JP | 2006-159427 | 6/2006 |

* cited by examiner

SHEET CASSETTE AND PRINTING SYSTEM

CROSS-REFERENCE TO RELATED APPLICATION

The present application is based on and claims priority to Japanese patent application No. 2018-055906, filed on Mar. 23, 2018, the entire contents of which are incorporated herein by reference.

BACKGROUND OF THE INVENTION

1. Field of the Invention

The present invention relates to sheet cassettes and printing systems.

2. Description of the Related Art

Conventional portable printers have a box shape and are relatively large, and are carried in a bag or the like. Portable printers are preferably small, light, and easy to carry. For portable printers, a sheet cassette may be used. See, for example, Japanese Laid-open Patent Publication Nos. 2006-159427 and 2004-345819.

SUMMARY OF THE INVENTION

According to an aspect of the present invention, a sheet cassette configured to store a recording sheet and connectable to a printer includes a battery, a storage, a communication terminal, and an electrode terminal. The storage is configured to store information. The sheet cassette is configured to perform communications between the sheet cassette and the printer through the communication terminal. The sheet cassette is configured to supply the electric power of the battery to the printer through the electrode terminal.

DESCRIPTION OF THE EMBODIMENTS

Figure 1:
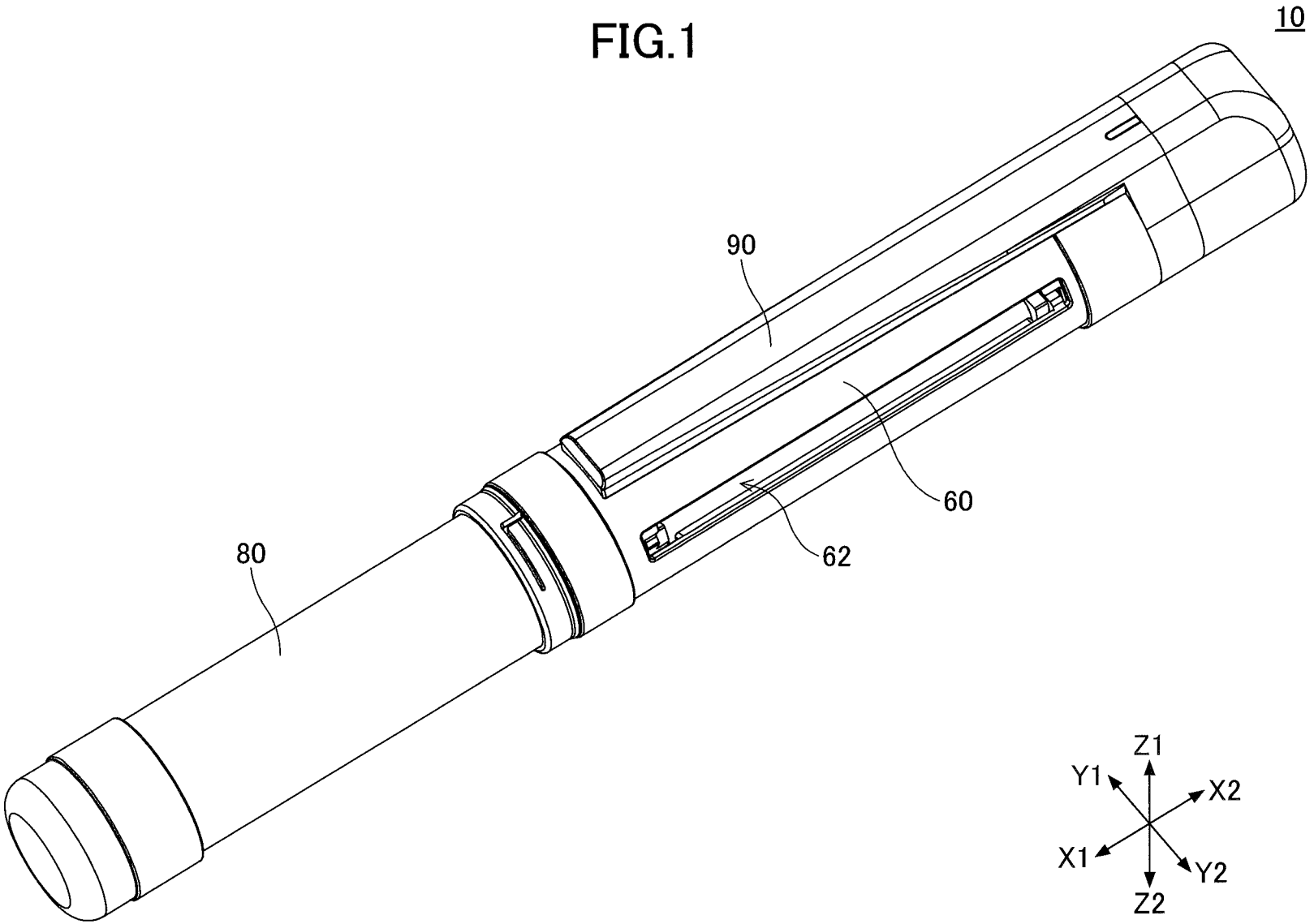
FIGS. 1, 2 and 3 are a perspective view, a cross-sectional view and a front view, respectively, of a printer.

Portable printers contain a battery and are driven with electric power from the battery. To make portable printers as small as possible, their functions such as a communication function and a filing function are limited.

There is, however, a demand for portable printers that can fully execute functions such as a communication function and a filing function.

According to an aspect of the present invention, a sheet cassette is connected to a printer to not only feed recording sheets but also improve functions of the printer, such as a communication function and a filing function.

One or more embodiments of the present invention are described below with reference to the accompanying drawings. In the following, the same members or the like are referred to using the same reference numeral, and duplicate description thereof is omitted. Furthermore, the embodiments are described using an XYZ coordinate system as defined as illustrated in the drawings. A direction along the X-axis is referred to as "X direction." A direction along the Y-axis is referred to as "Y direction." A direction along the Z-axis is referred to as "Z direction." The X direction, the Y direction, and the Z direction are orthogonal to one another.

When using a portable printer as an Internet of Things (IoT) device, functions that can be installed in the IoT device are limited because of the limitation of being a pen type in its implementation. Meanwhile, the portable printer is usable for various purposes as an IoT device, and it is desired to install numerous functions in the portable printer. Specifically, it is desired to address applications that require a lot of memory.

When a smartphone contains applications and various data, the portable printer cannot receive data from the smartphone within a required time, thus, for example, causing a decrease in print speed, unless the speed of communication with the smartphone increases.

Therefore, printers such as pen-type IoT devices as well are desired to achieve high-speed processing and various kinds of processes.

According to an embodiment, normal IoT processing is executed by a printer alone, while image data and the like are filed in a memory implemented in a sheet cassette that feeds recording sheets to the printer. For example, when printing image data, the printer accesses the memory of the sheet cassette as an internal extended memory, using a communication device such as a universal asynchronous receiver-transmitter (UART) to obtain image data for printing recorded in the memory, and prints the obtained image data. The printer also performs radio communications with an external system to transmit and receive information, and processes the information based on information recorded in the memory of the sheet cassette. Thus, the printer according to this embodiment can configure an optimal system according to circumstances.

Figure 2:
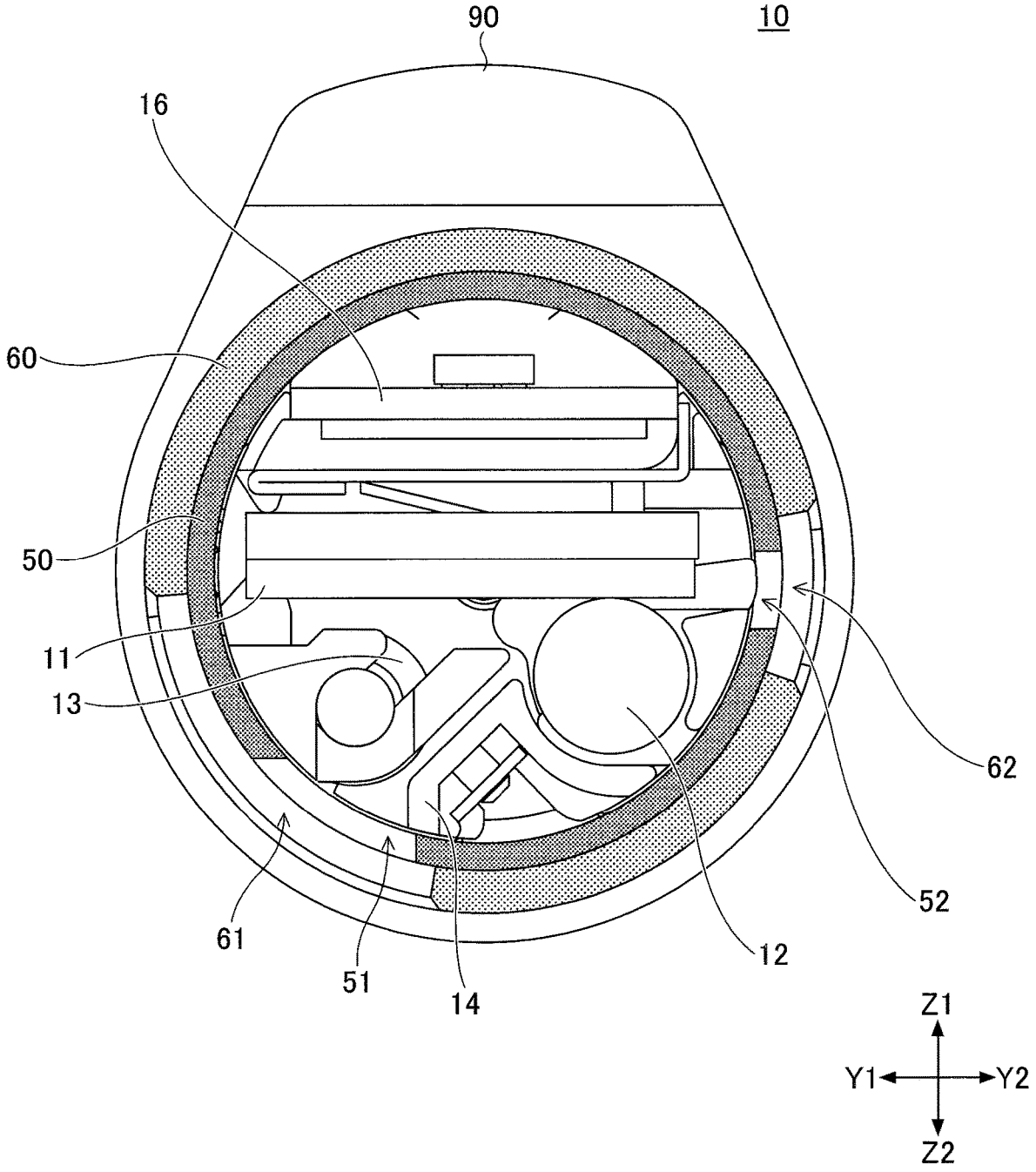
Figure 3:
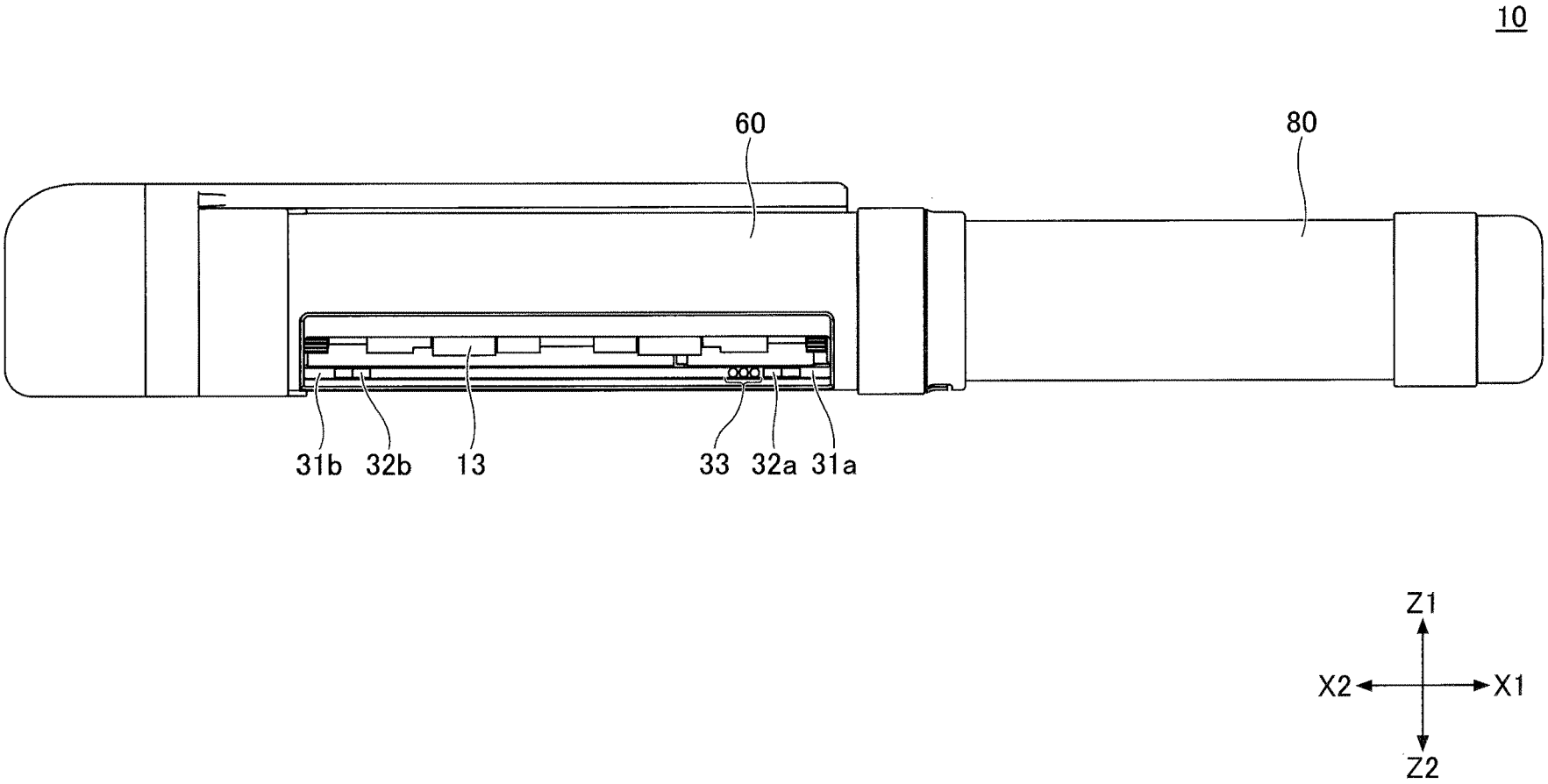

A portable printer 10 to which a sheet cassette according to this embodiment is attachable is described with reference to FIGS. 1 through 3. The cylindrical printer 10 is also referred to as a pen-type printer. FIGS. 1, 2 and 3 are a perspective view, a cross-sectional view and a front view, respectively, of the printer 10. The printer 10 is an IoT device including a printing function and a radio communication function.

The printer 10 includes a print head 11 such as a thermal head, a platen roller 12, a feed roller 13, a sheet guide 14, a spring, a control board 16, an inner cover 50, and an outer cover 60. The print head 11 is pressed against the platen roller 12 by the spring. A recording sheet is fed by the feed roller 13 to move into the printer 10 along the sheet guide 14. The recording sheet is conveyed by the platen roller 12 while being held between the print head 11 and the platen roller 12, and is thereafter discharged. An electronic circuit and electronic components that control the printer 10 are mounted on the control board 16.

The cylindrical inner cover 50 is rotatably accommodated in the cylindrical outer cover 60. The inner cover 50 includes an insertion opening 51 and a discharge opening 52. The outer cover 60 includes an insertion opening 61 and a discharge opening 62.

When the printer 10 performs printing, the opening 51 and the opening 61 are aligned to be open, and the opening 52 and the opening 62 are aligned to be open. A recording sheet enters the printer 10 through the openings 51 and 61, and is discharged through the openings 52 and 62. A sheet cassette 100 can be connected to the opening 61 with the openings 51 and 61 being open.

Print data are transmitted from an information terminal to the printer 10 through radio communication using, for example, Bluetooth Low Energy (BLE). The printer 10 includes a storage such as a memory, which is limited in storage capacity to reduce the size of the printer 10.

The printer 10 includes a power supply 80 storing a lithium-ion battery, which is a rechargeable battery, and can be driven with electric power supplied from the lithium-ion battery. The printer 10 includes a built-in connector for charging a rechargeable battery. In this specification, the battery contained in the printer 10 may be referred to as "printer battery."

Referring to FIG. 3, the printer 10 includes connection parts 31*a* and 31*b*, electrode terminals 32*a* and 32*b*, and communication terminals 33, which are exposed in the openings 51 and 61. The connection parts 31*a* and 31*b* are positioned one near each end of the openings 51 and 61. The electrode terminals 32*a* and 32*b* are provided between the connection parts 31*a* and 31*b*. The communication terminals 33 are provided between the electrode terminals 32*a* and 32*b*.

The connection parts 31*a* and 31*b* formed of a magnetic material such as a metal material including iron, cobalt, or nickel are magnetically attracted to magnets provided in the cassette 100. The electrode terminals 32*a* and 32*b* are connected to electrode terminals of the cassette 100 to supply electric power from the cassette 100 to the printer 10. The communication terminals 33 are connected to communication terminals of the cassette 100 to perform serial data information communications between the printer 10 and the cassette 100.

The printer 10, which is approximately 18 mm in diameter and approximately 165 mm to 170 mm in length, can be carried around without feeling stress. The printer 10 includes a hook 90 which allows the printer 10 to be put in the chest pocket of clothes to be carried around just like a pen.

Figure 4:
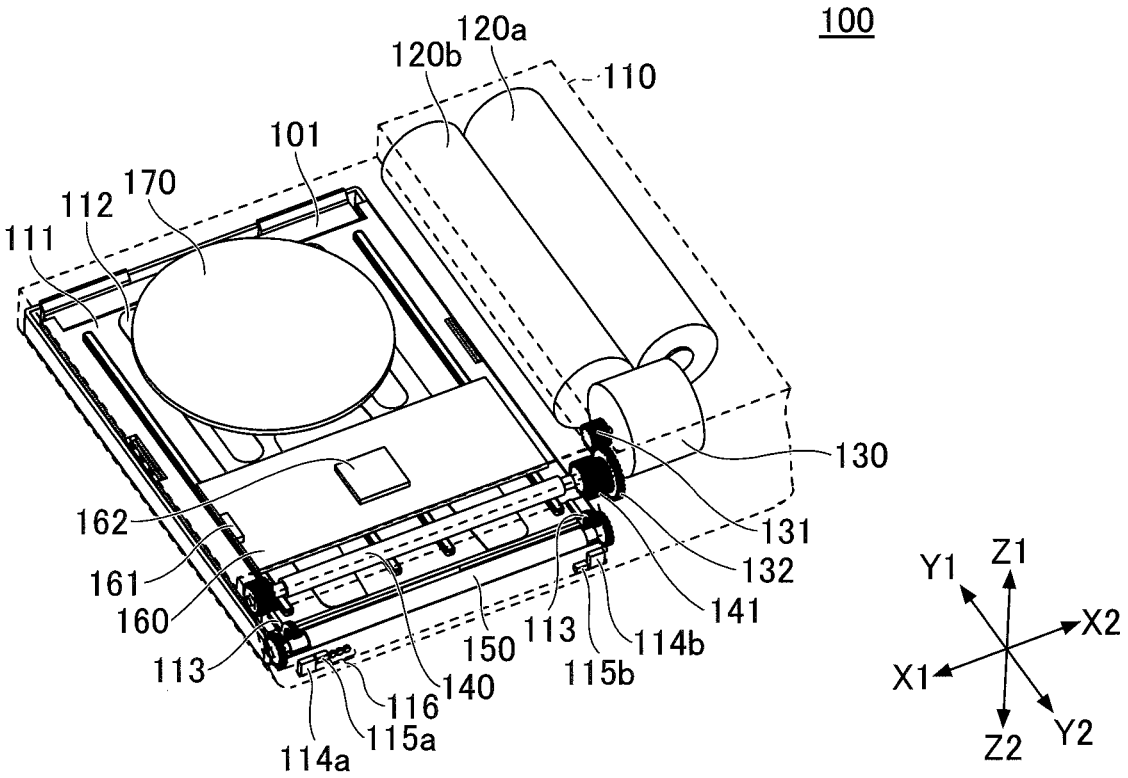
FIGS. 4, 5 and 6 are a partially phantom top-side perspective view, a front view and a perspective view, respectively, of a sheet cassette according to an embodiment.
Figure 5:
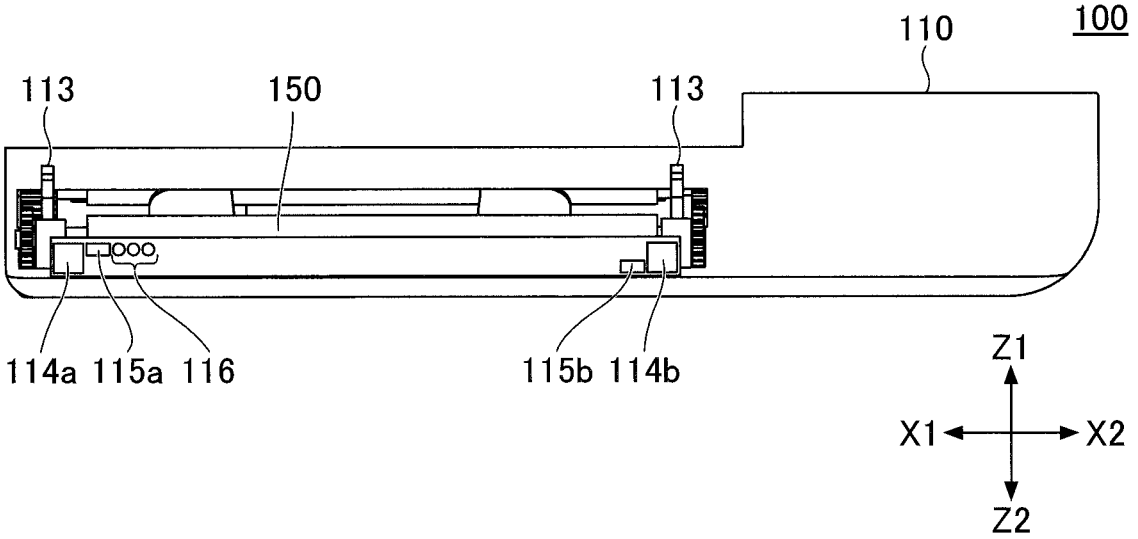
Figure 6:
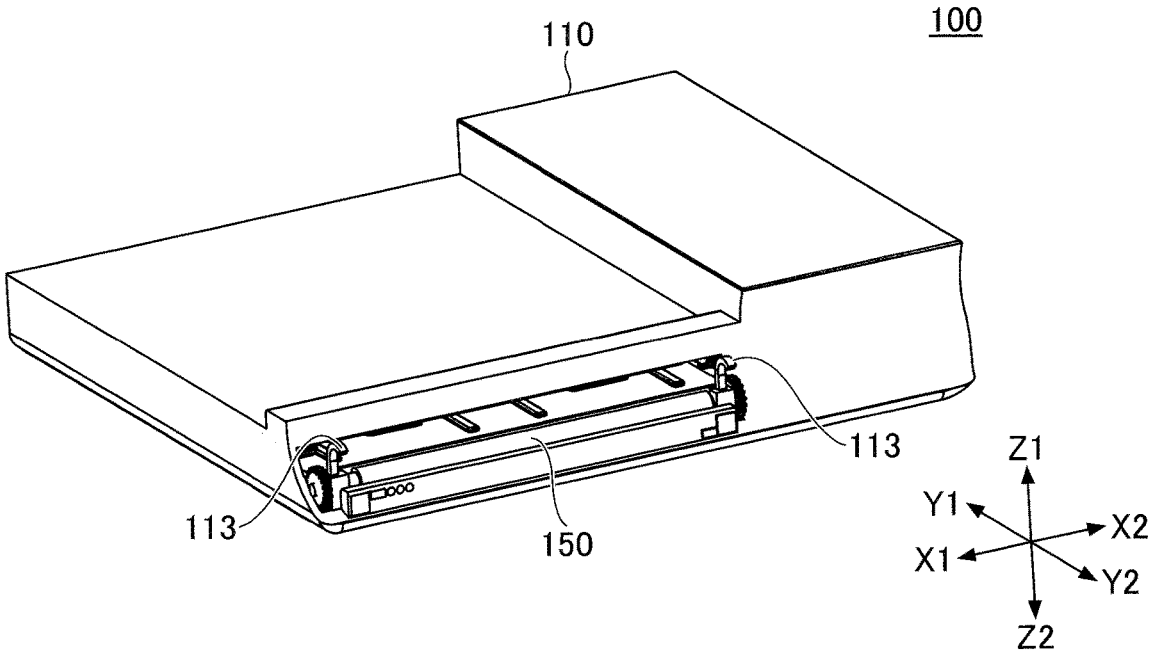

The cassette 100 according to this embodiment is attached to the printer 10, and forms a printing system according to this embodiment together with the cassette 100. FIG. 4 is a phantom top-side perspective view of a housing 110 of the cassette 100. FIGS. 5 and 6 are a front view and a perspective view, respectively, of the cassette 100.

The cassette 100 is configured to store recording sheets 101 in the housing 110, and includes two rechargeable batteries 120*a* and 120*b*, a motor 130, a feed roller 140, an assist roller 150, a control board 160, and a transmitting coil 170 for power transmission provided in the housing 110.

A partition plate 111 is provided in the housing 110. A spring 112 is provided on the upper surface of the partition plate 111. The cassette 100 is compatible with fanfold paper, which is folded and stored below the partition plate 111 in the housing 110. An end of the fanfold paper is placed on the upper side of the partition plate 111 to be pressed upward by the spring 112.

The batteries 120*a* and 120*b* are connected in series. The series-connected batteries 120*a* and 120*b* may be collectively referred to as "battery 120." The printer battery is a single-cell battery whose nominal voltage is approximately 3.6 V, while the battery 120 supplies electric power of a nominal voltage of approximately 7.2 V, which is twice the nominal voltage of the printer battery. The electric power of the battery 120 is supplied to the motor 130, the control board 160, and the coil 170, and may also be supplied to the printer 10 as described below.

The motor 130 rotates the feed roller 140. A gear 131 and a gear 141 are attached to the shaft of the motor 130 and the shaft of the feed roller 140, respectively. A gear 132 is provided between the gears 131 and 141.

In a view from the X2 side, when the motor 130 rotates clockwise, the gear 131 also rotates clockwise, so that the gear 132 meshing with the gear 131 rotates counterclockwise. When the gear 132 rotates counterclockwise, the gear 141 meshing with the gear 132 rotates clockwise, so that the feed roller 140 rotates clockwise. The feed roller 140, on its lower side, contacts the topmost recording sheet 101, and conveys the recording sheets 101 toward the printer 10 to feed the recording sheets 101 one by one to the printer 10.

Two claws 113 for attaching the cassette 100 to the printer 10 are provided at the Y2 end of the cassette 100. The cassette 100 is attached to the printer 10 by hooking the claws 113 over the shaft of the feed roller 13.

The assist roller 150 rotates independent of the feed roller 140. When the cassette 100 is attached to the printer 10, the assist roller 150 rotates in tandem with the feed roller 13 to assist feeding of the recording sheets 101 to the printer 10.

On a Y2 surface of the cassette 100, which is a surface to be attached to the printer 10, magnets 114*a* and 114*b* for magnetically attracting the printer 10, electrode terminals 115*a* and 115*b* for supplying electric power to the printer 10, and communication terminals 116 for communicating information with the printer 10 are provided. A control integrated circuit (IC) is mounted on the control board 160 to control various operations in the cassette 100, such as the rotation of the motor 130. A universal serial bus (USB) connector 161 that communicates with an external information terminal such as a personal computer, and a storage 162 that stores information transmitted from the information terminal are provided on the control board 160. The storage 162 is a semiconductor memory, and for example, image data transmitted from the information terminal are stored in the storage 162 via the USB connector 161. Accordingly, it is possible to access the storage 162 via the USB connector 161 from the information terminal independent of the printer 10 without intervention of the printer 10. The coil 170 is for charging the printer battery.

Figure 7:
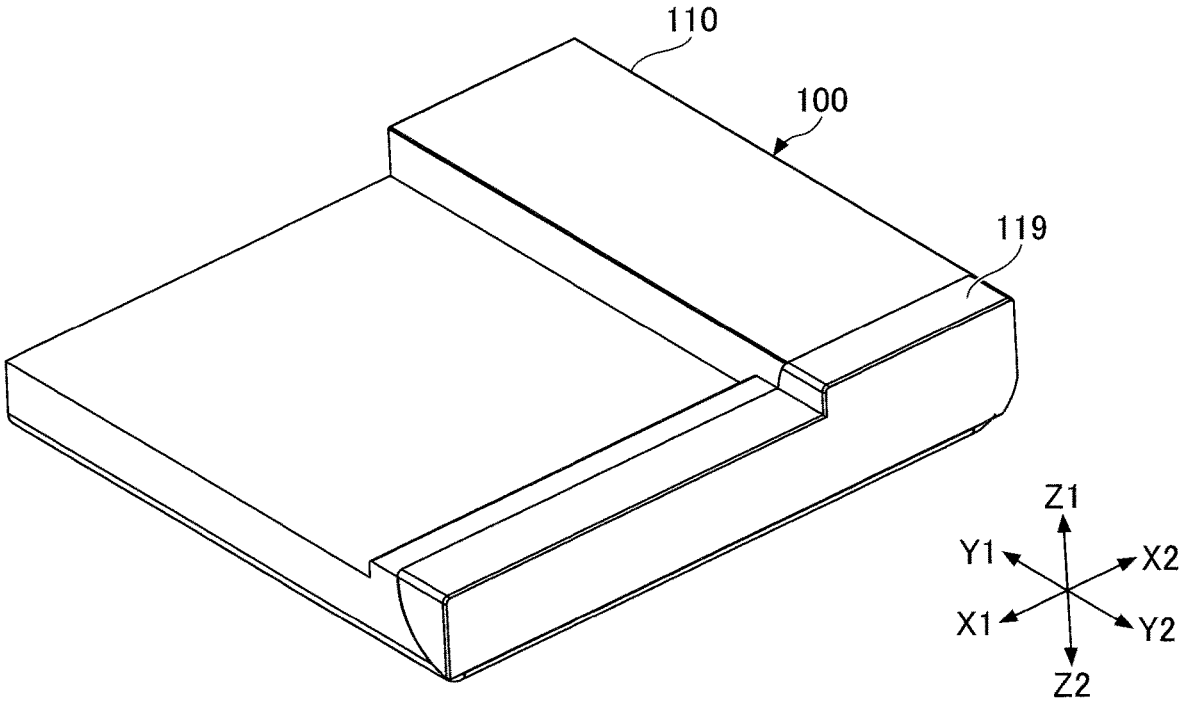
FIG. 7 is a diagram illustrating the sheet cassette according to the embodiment.

When the cassette 100 is not connected to the printer 10, the claws 113, the magnets 114*a* and 114*b*, the electrode terminals 115*a* and 115*b*, the communication terminals 116, and the assist roller 150 are exposed on the front side of the cassette 100. Therefore, as illustrated in FIG. 7, a front cover 119 may be attached to the front side of the cassette 100 so as to make it possible to carry the cassette 100 even when the cassette 100 is disconnected from the printer 10.

Figure 8:
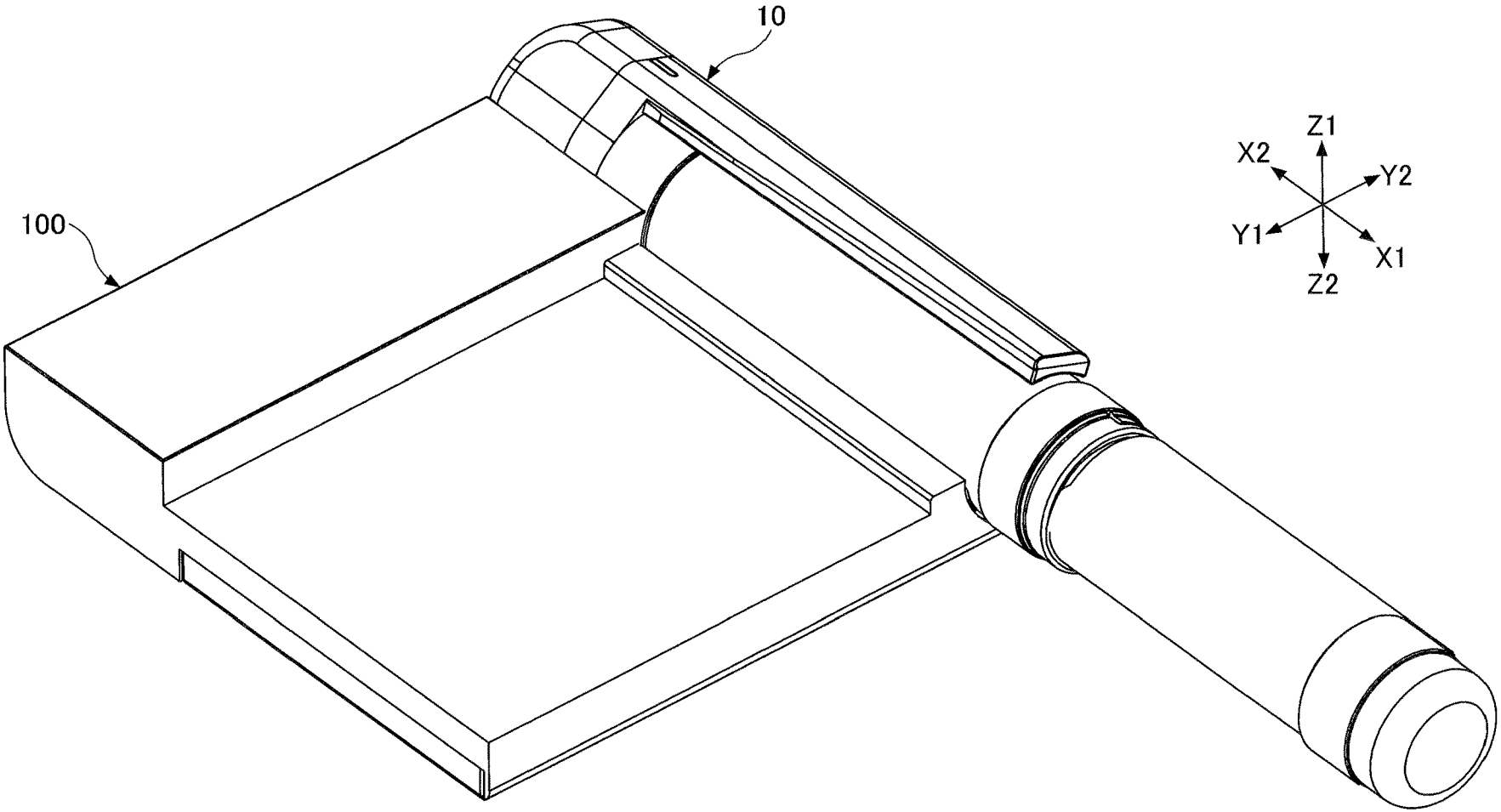
FIG. 8 is a perspective view of a printing system according to the embodiment.

A connection of the cassette 100 and the printer 10 is described. As illustrated in FIG. 8, the cassette 100 is attached to the printer 10 to form a printing system according to this embodiment.

With the claws 113 being hooked over the shaft of the feed roller 13, the magnets 114*a* and 114*b* and the connection parts 31*a* and 31*b* magnetically attract each other to closely attach the cassette 100 and the printer 10 together. As a result, the electrode terminals 115*a* and 115*b* are electrically connected to the electrode terminals 32*a* and 32*b* to allow electric power to be supplied from the cassette 100 to the printer 10.

Furthermore, the communication terminals 116 are electrically connected to the corresponding communication terminals 33 to allow information to be communicated between the cassette 100 and the printer 10. Communications between the cassette 100 and the printer 10 are faster than radio communications using BLE. Thus, it is possible to communicate information at high speed between the cassette 100 and the printer 10.

The electrode terminals 115*a* and 115*b* are provided near the claws 113, being spaced apart from each other. When the cassette 100 is not connected normally to the printer 10, such as when the cassette 100 is attached at an angle to the printer 10, at least one of the electrode terminals 115*a* and 115*b* is not connected to a corresponding one of the electrode terminals 32*a* and 32*b*. Accordingly, no electric power is supplied from the cassette 100 to the printer 10 to prevent the printer 10 from operating, and a recording sheet jam or damage to gears due to an operation under loose connection can be prevented. One of the electrode terminals 115*a* and 115*b* is positive and the other is negative.

Figure 9:
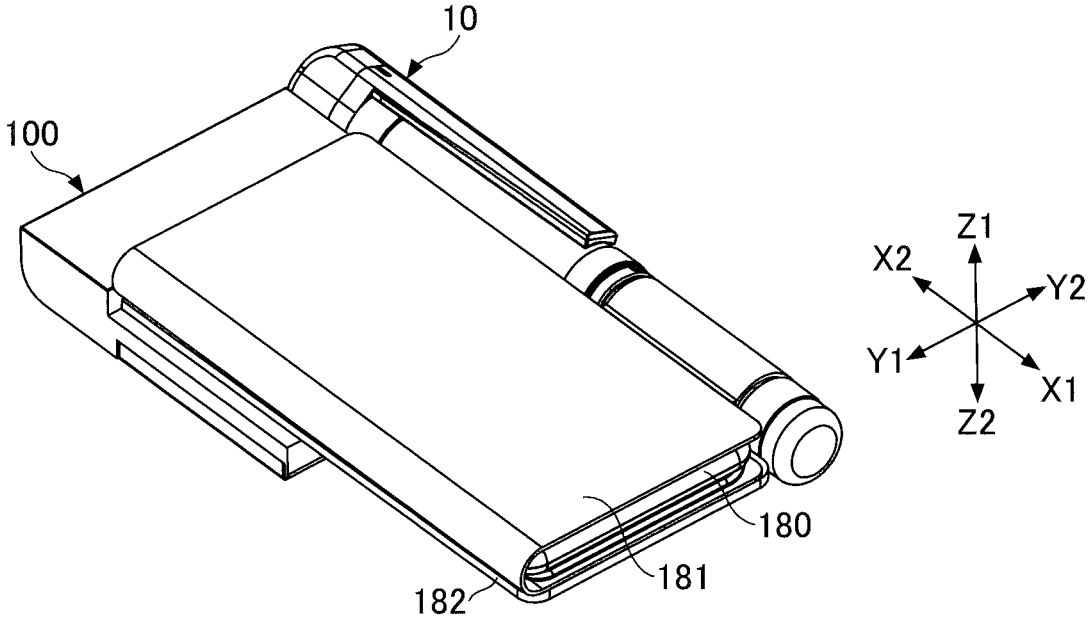
FIGS. 9 and 10 are a top-side perspective view and a bottom-side perspective view, respectively, of the printing system of the embodiment to which an information terminal is attached.
Figure 10:
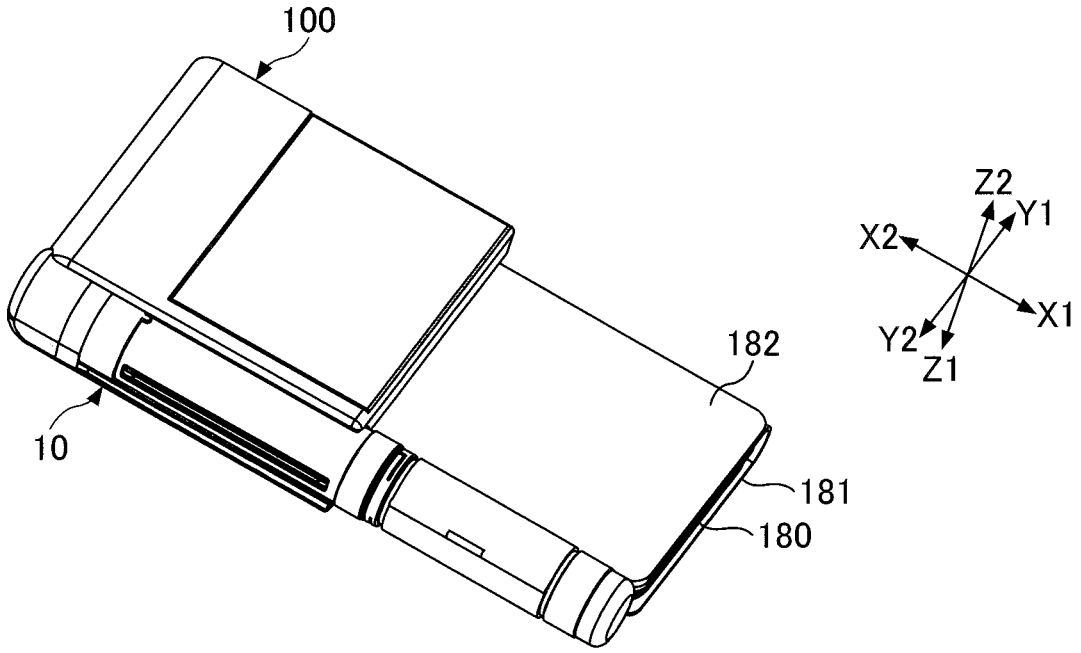

Attachment of a portable information terminal 180 such as a smartphone to the cassette 100 and the printer 10 is described with reference to FIGS. 9 through 12. FIGS. 9 and 10 are a top-side perspective view and a bottom-side perspective view, respectively, of the printer 10 to which the information terminal 180 is attached. As illustrated in FIGS. 9 and 10, the information terminal 180 is attached to the printer 10 by attaching the printer 10 to an attachment plate 182 provided on a cover 181. Referring to FIG. 9, the information terminal 180 is attached to the printer 10 while being contained in the cover 181. The attachment plate 182 is attached to the cover 181 by bonding using an adhesive agent or by magnetic attraction using a magnet.

Figure 11:
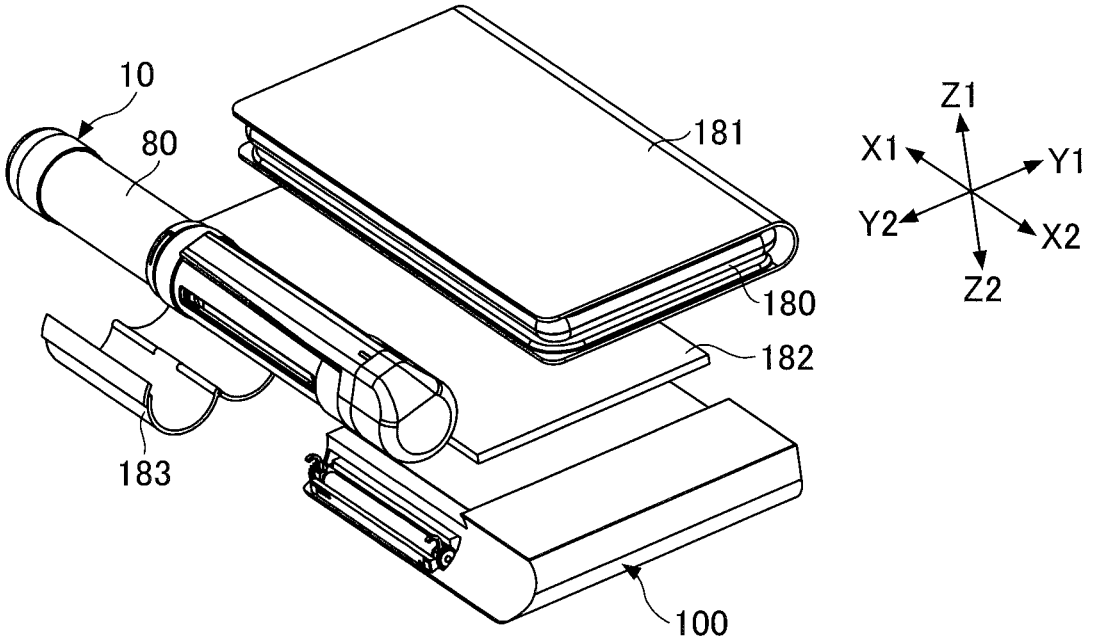
FIG. 11 is an exploded perspective view of the printing system according to the embodiment.
Figure 12:
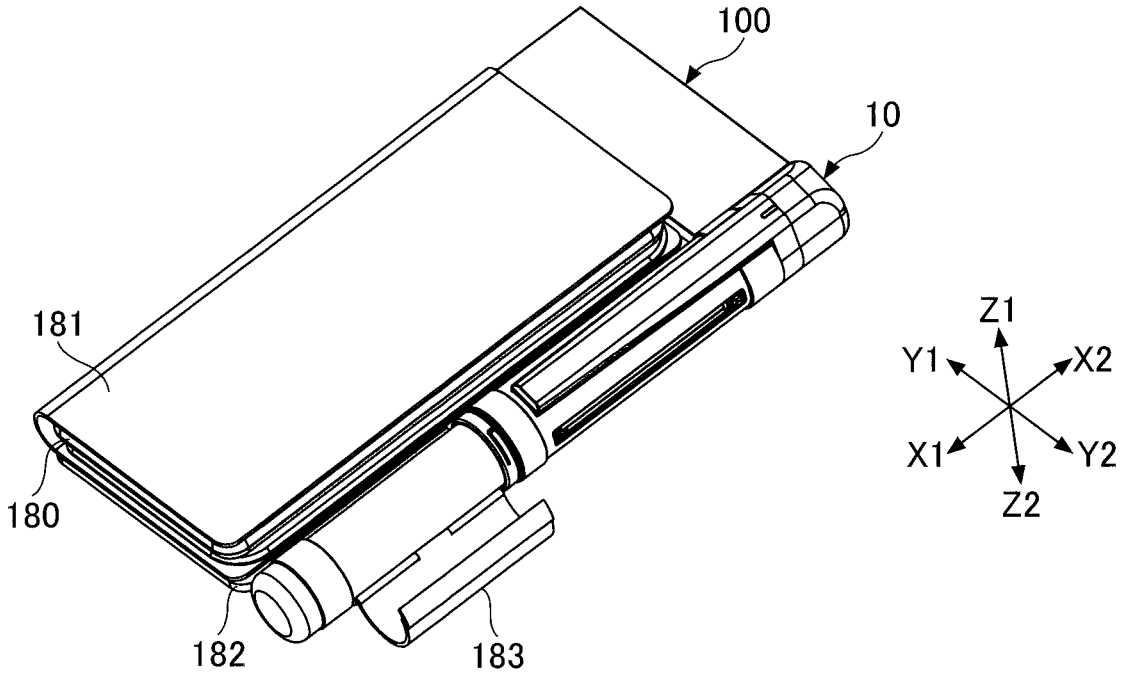
FIG. 12 is a diagram illustrating how to attach the information terminal to the printing system according to the embodiment.

FIG. 11 is a perspective view of the information terminal 180 with the cover 181, the attachment plate 182, the printer 10, and the cassette 100 in a separated state. FIG. 12 is a diagram illustrating the process of attaching the printer 10 to the attachment plate 182 using a fixing band 183. Referring to FIGS. 11 and 12, the attachment plate 182 is provided with the fixing band 183 for fixing the printer 10. The printer 10 is fixed to the attachment plate 182 by covering the periphery of the power supply 80 with the fixing band 183.

Figure 13:
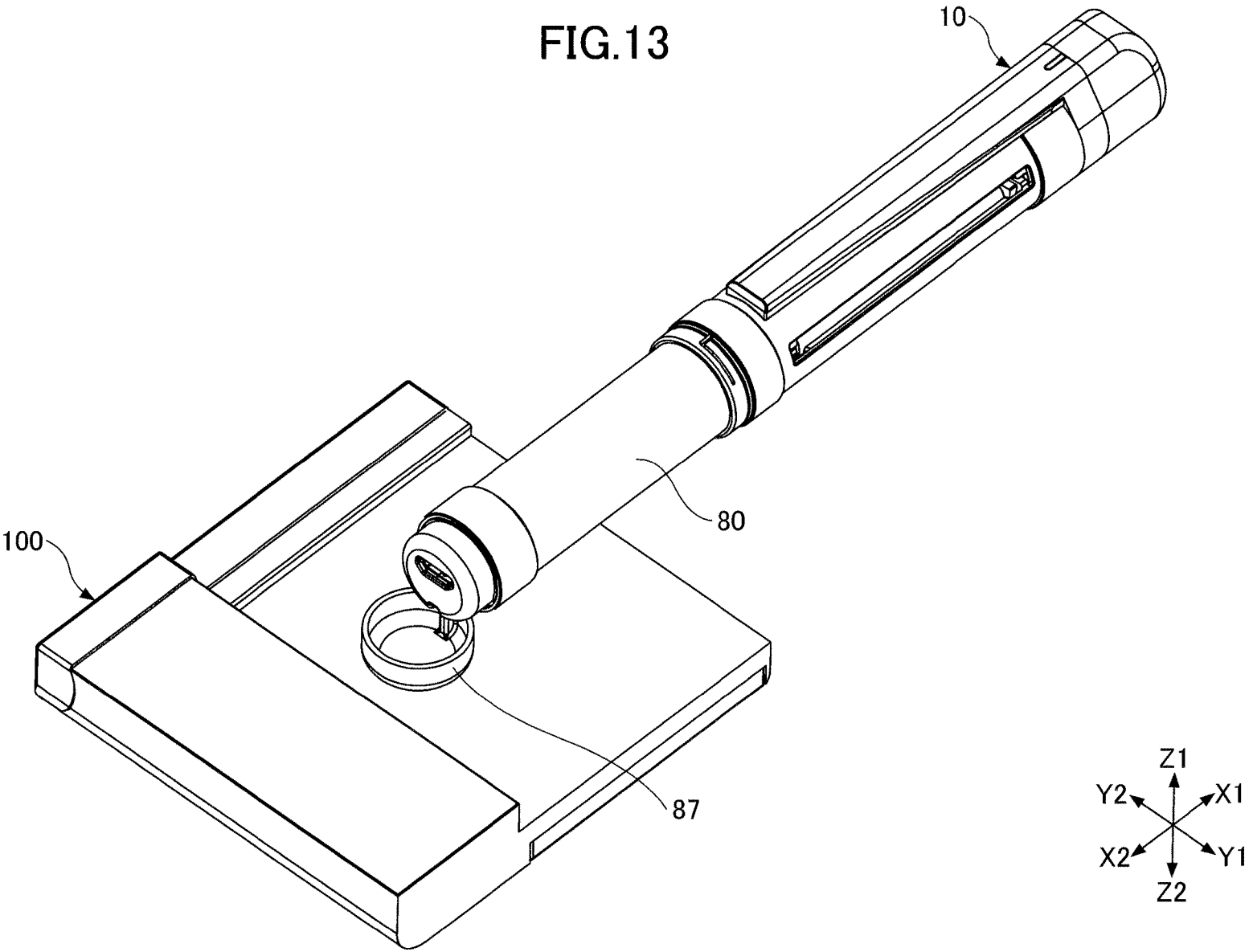
FIG. 13 is a diagram illustrating how to perform wireless charging in the printing system according to the embodiment.

Furthermore, as illustrated in FIG. 13, a cap covering a USB connector provided at the end of the power supply 80 includes a built-in receiving coil 87 for power reception. When the coil 87 is moved close to part of the cassette 100 where the coil 170 is provided to receive electromagnetic waves radiated from the coil 170, the printer battery can be charged with electric power generated from the coil 87.

Figure 14:
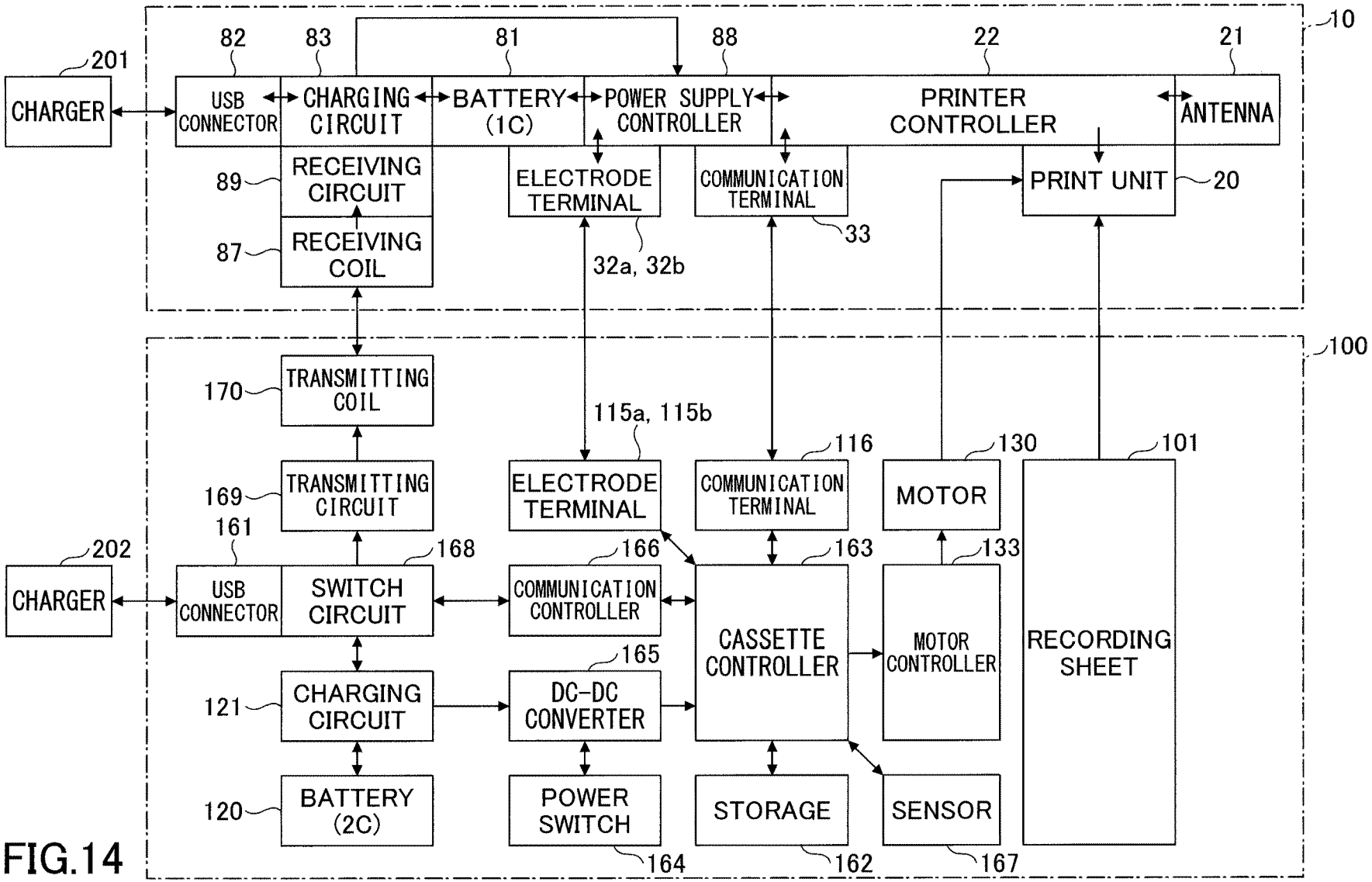
FIG. 14 is a block diagram illustrating a configuration of the printing system according to the embodiment.

Next, control of the printing system is described. FIG. 14 illustrates the printing system.

The printer 10 includes a print unit 20, an antenna 21, a printer controller 22, the electrode terminals 32*a* and 32*b*, the communication terminals 33, a battery 81, a USB connector 82, a charging circuit 83, the coil 87, a power supply controller 88, and a receiving circuit 89 for wireless charging.

The print unit 20 performs printing on a recording sheet, and includes the print head 11 and the platen roller 12 that conveys a recording sheet. The antenna 21 is for communicating information with the information terminal 180 using BLE. The printer controller 22 controls printing operations and BLE communications, and is mounted on the control board 16. When the cassette 100 is mounted on the printer 10, the printer controller 22 can perform communications with a cassette controller 163 of the cassette 100 via the communication terminals 33 and 116. The printer controller 22 can access files stored in the storage 162, which is available as a large-scale file memory, via the high-speed interface of the communication terminals 33 and 116. Therefore, the printer controller 22 can access images and macros recorded in the storage 162 and perform print control and external communications using the images and macros. The information terminal 180 can access information stored in the storage 162 through radio communications via the antenna 21.

The battery 81 is a single-cell (1C) rechargeable battery and supplies nominal electric power of approximately 3.6 V. To charge the battery 81, an external charger 201 is connected to the USB connector 82 to supply electric power from the charger 201 to the battery 81 via the charging circuit 83. The power supply controller 88 controls the power supply 80 and is connected to the battery 81, the electrode terminals 32*a* and 32*b*, and the communication terminals 33. The communication terminals 33 are connected to the print unit 20 as well via the printer controller 22.

The recording sheets 101 to be subjected to printing are loaded in the cassette 100. The cassette 100 includes the electrode terminals 115*a* and 115*b*, the communication terminals 116, the battery 120, a charging circuit 121, the motor 130, a motor controller 133, the USB connector 161, the storage 162, the cassette controller 163, a power switch 164, a DC-DC converter 165, a communication controller 166, a sensor 167, a switch circuit 168, a transmitting circuit 169 for wireless charging, and the coil 170.

The battery 120 is a two-cell (2C) rechargeable battery, and supplies nominal electric power of approximately 7.2 V. To charge the battery 120, an external charger 202 is connected to the USB connector 161 to supply electric power to the battery 120 via the switch circuit 168 and the charging circuit 121. The motor controller 133 controls the motor 130 based on the control of the cassette controller 163.

The cassette controller 163, which is a circuit that controls various operations of the cassette 100, communicates with the printer 10, controls automatic feeding of the recording sheets 101, controls wireless charging, and files information, for example. The cassette controller 163 also communicates with an external information terminal via the USB connector 161, and files received information. When performing printing, the cassette controller 163 communicates macros and images filed in the storage 162 with the printer 10. Furthermore, the cassette controller 163 communicates with an external system using a BLE communication function of the printer 10.

The electric power of the battery 120 is input to the DC-DC converter 165 via the charging circuit 121. By turning on the power switch 164, the DC-DC converter 165 operates to supply electric power to the cassette controller 163, so that electric power is supplied from the cassette controller 163 to the entire cassette 100.

The switch circuit 168 switches, based on the control of the communication controller 166, supplying electric power from the USB connector 161 to the battery 120 and supplying electric power from the battery 120 to the coil 170.

Operations of the printer 10 and the cassette 100 are described with reference to FIGS. 15 through 20, where part of the printer 10 and the cassette 100 that is in operation is indicated by a solid line, and part of the printer 10 and the cassette 100 that is not in operation is indicated by a dashed line.

Figure 15:
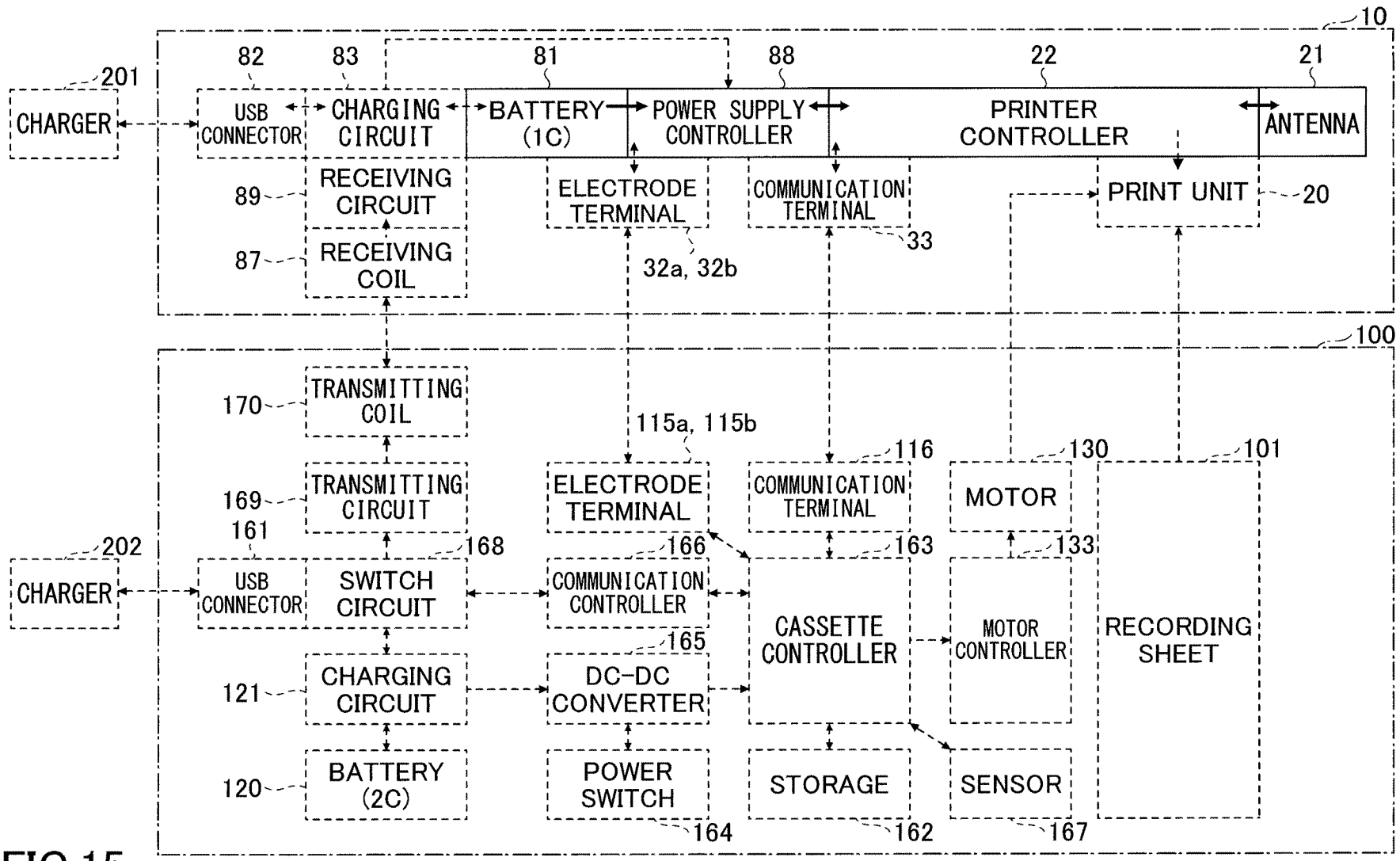
FIGS. 15, 16, 17, 18, 19 and 20 are diagrams illustrating the printing system according to the embodiment.

FIG. 15 illustrates a case where the printer 10 to which the cassette 100 is connected performs BLE communications. In this case, no printing is performed, and the battery 81 serves as the power supply of the printer 10. In this state, the printer controller 22 is activated, so that BLE communications via the antenna 21 can be performed. In the cassette 100, the power switch 164 is turned off, and the cassette controller 163 or the storage 162 is not activated. Accordingly, the cassette controller 163 does not control the cassette 100.

Figure 16:
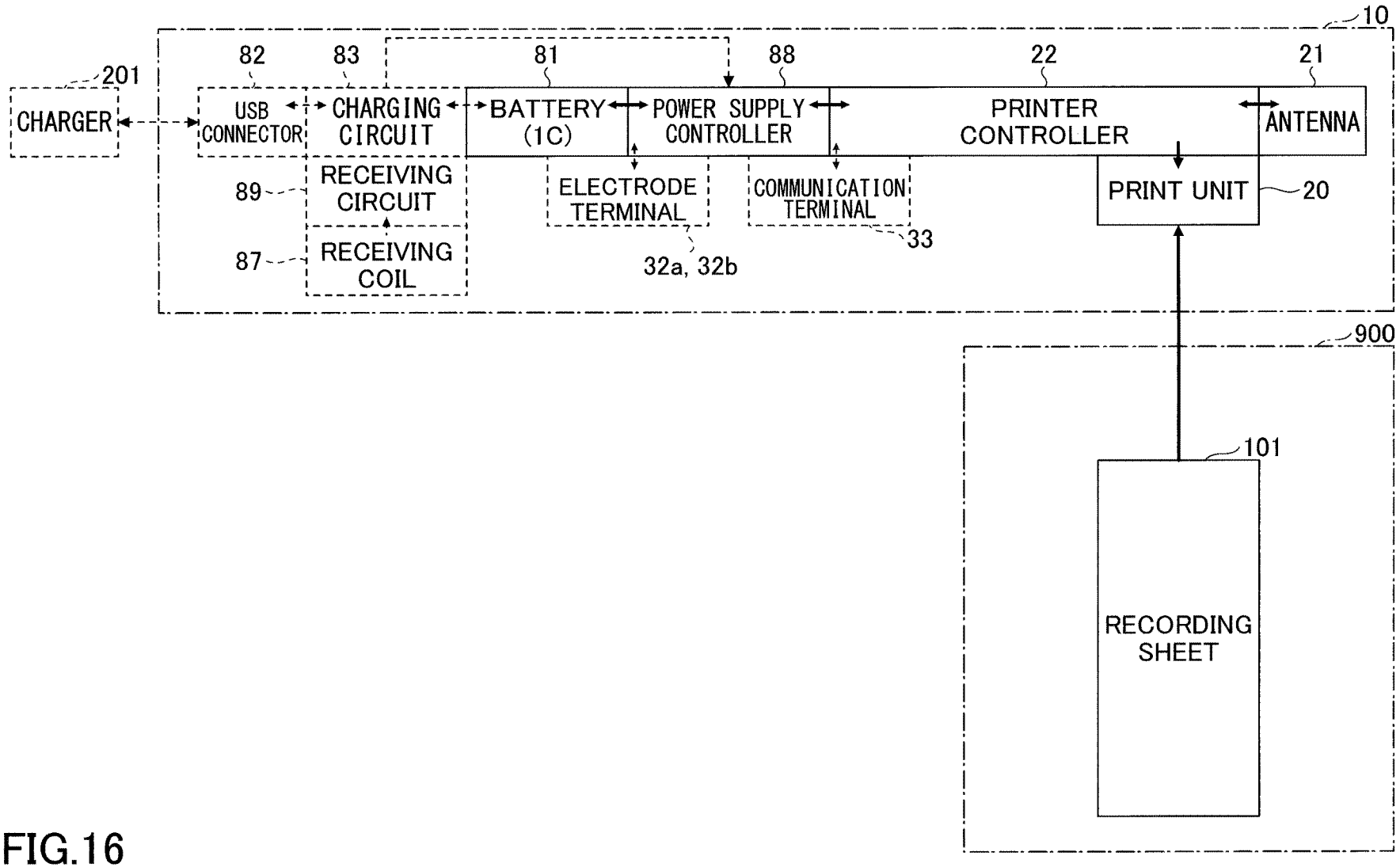

A printing system in which a simplified sheet cassette 900 is connected to the printer 10 is described with reference to FIG. 16. The cassette 900 is only loaded with the recording sheets 101, and is not provided with a cassette controller or a storage. Furthermore, because no power supply is installed in the cassette 900, the battery 81 serves as the power supply of the printer 10. In this case as well, the printer 10 is fed with the recording sheets 101 from the cassette 900 and prints information received through the antenna 21. However, the printer 10 cannot perform high-speed printing because the battery 81 supplies electric power to the printer 10.

Figure 17:
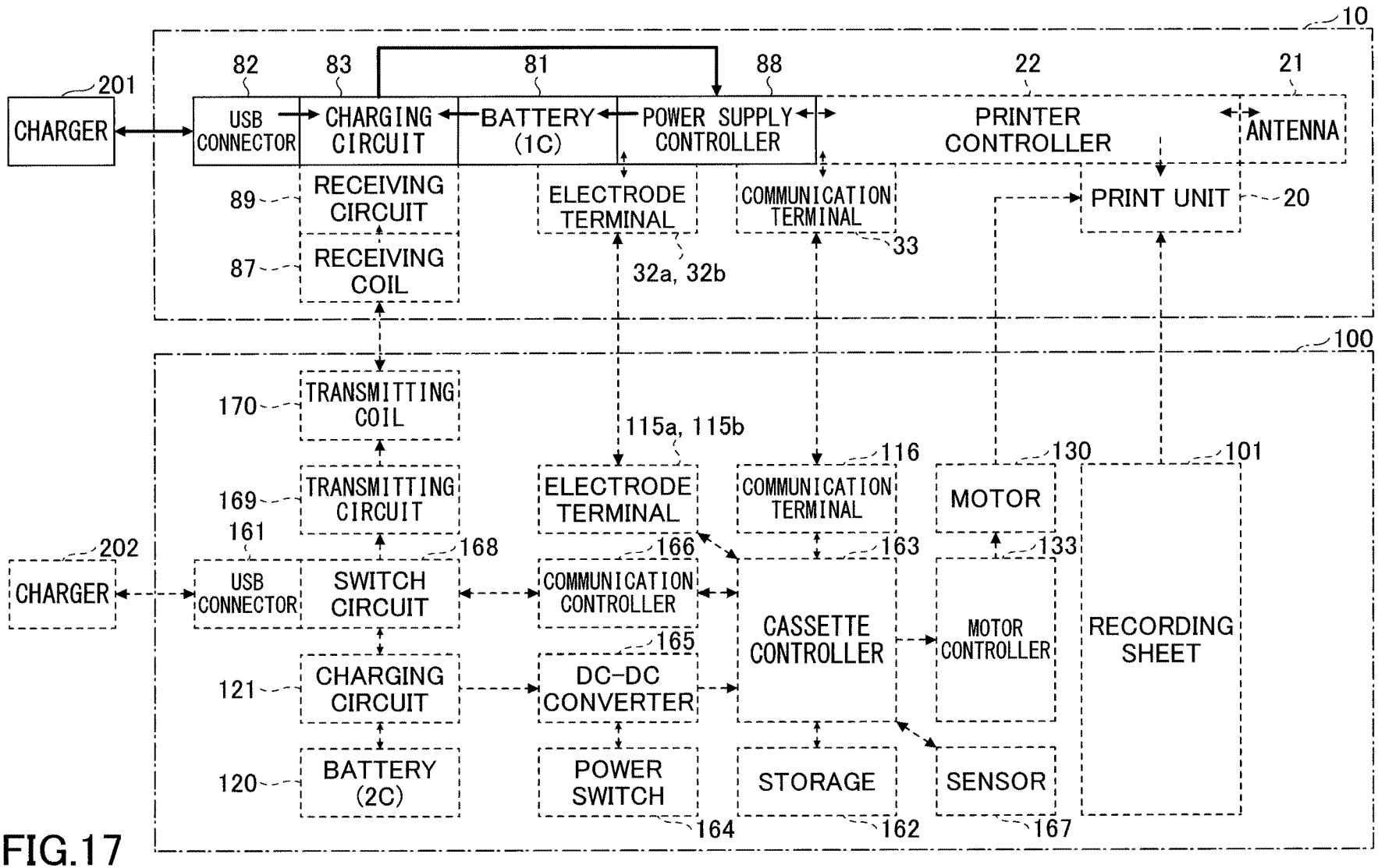

Charging of the battery 81 using the charger 201 is described with reference to FIG. 17. When the battery 81 is charged by the charger 201, the power switch 164 is turned off. When the charger 201 is connected to the USB connector 82, electric power is supplied from the charger 201 to the battery 81 via the USB connector 82, the charging circuit 83, and the power supply controller 88, so that the battery 81 is charged.

Figure 18:
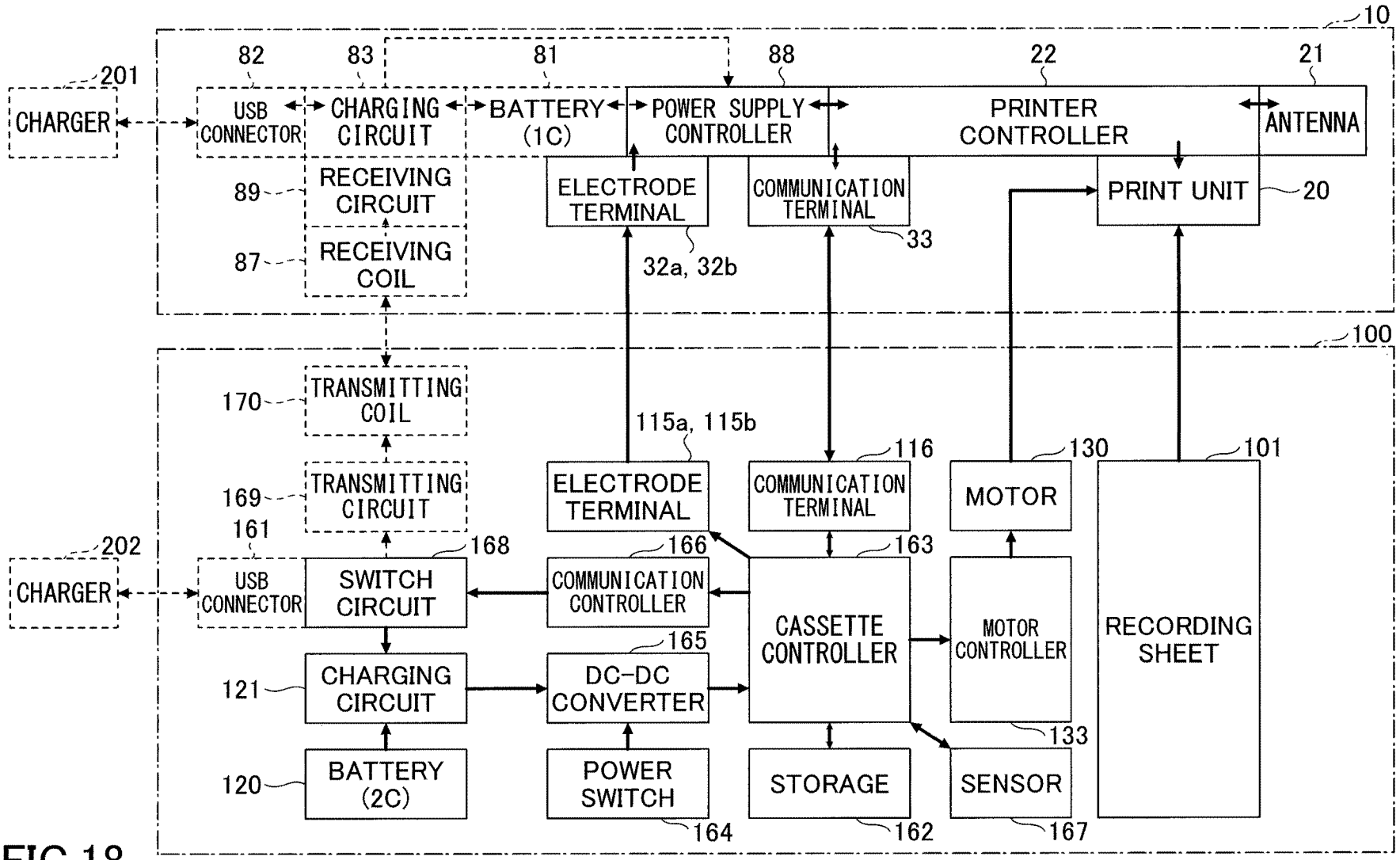

Printing by the printer 10 with the cassette 100 being activated is described with reference to FIG. 18. In this case, electric power is supplied to the printer 10 from the battery 120. First, the power switch 164 is turned on to active the cassette 100, so that the electric power of the battery 120 is supplied to the cassette controller 163 via the charging circuit 121 and the DC-DC converter 165. The cassette controller 163 locks this state in the switch circuit 168 via the communication controller 166.

In this state, when a command to supply the electric power of the battery 120 to the printer 10 is transmitted from the printer controller 22 to the cassette controller 163 via the communication terminals 33 and 116, the print unit 20 operates with the electric power of the battery 120 supplied from the cassette controller 163 via the electrode terminals 115*a*, 115*b*, 32*a* and 32*b*. This enables high-speed printing by the printer 10. Printing by the printer 10 may be controlled by operating, for example, the touchscreen of an information terminal via the BLE communication. The low transmission rate of BLE communications hardly becomes a problem because the communication volume of a control signal such as a print command signal is low. Information received from the information terminal is input to the printer controller 22, and print data included in the received information are transmitted to the cassette controller 163 via the communication terminals 33 and 116 by the printer controller 22. The cassette controller 163 reads image data stored in the storage 162, and transmits the image data to the printer controller 22. This process makes the image data printable in the print unit 20. Thereafter, a signal that requests feeding of the recording sheet 101 is transmitted from the printer controller 22 to the cassette controller 163. In response to receiving the feed request signal, the cassette controller 163 rotates the motor 130 via the motor controller 133. When the motor 130 rotates, the gear 131 also rotates to rotate the gears 132 and 141. As the gear 141 rotates, the feed roller 140 rotates to feed the recording sheet 101 contacting the feed roller 140.

Communications between the cassette 100 and the printer 10 are not radio communications but direct transmission of electrical signals. Therefore, it is possible to communicate information at high speed. Accordingly, even when an object of printing is image data, it is possible to perform printing without taking time.

Furthermore, the storage 162 can be used as an external memory of the printer 10. For example, information stored in an information terminal such as a personal computer can be stored in the storage 162. In this case, the information terminal is connected to the USB connector 161, and information such as image data stored in the information terminal is transmitted to the cassette 100 via the USB connector 161. The cassette controller 163 stores the received information in the storage 162.

Figure 19:
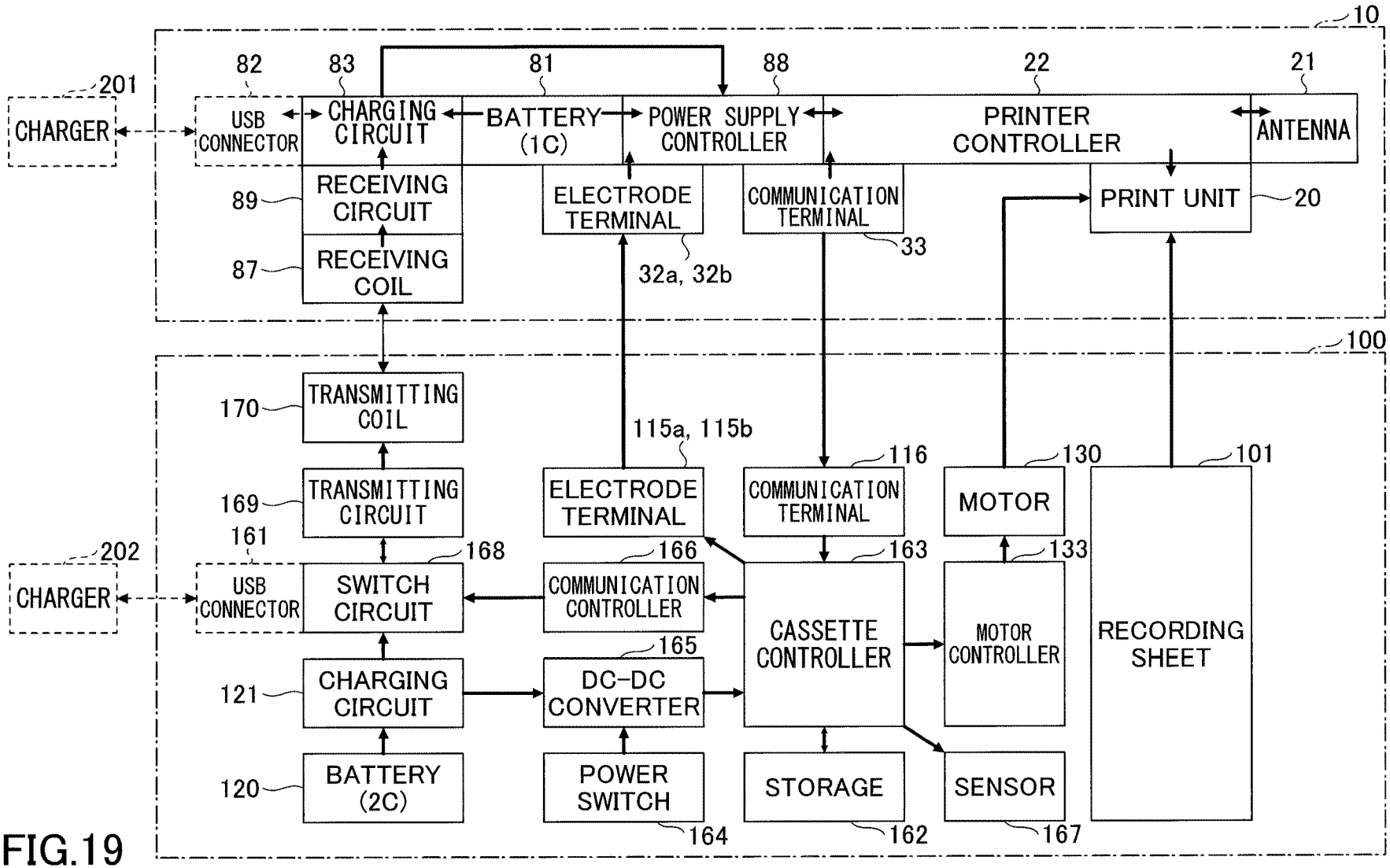

Furthermore, it is possible to charge the battery 81 by supplying electric power to the printer 10 from the battery 120 during printing operations. In this case, by operating the printer 10, a signal requesting wireless charging of the battery 81 is transmitted from the printer controller 22 to the cassette controller 163 via the communication terminals 33 and 116 as illustrated in FIG. 19. In response to receiving this signal, the cassette controller 163 switches the switch circuit 168 to supply the electric power of the battery 120 to the transmitting circuit 169. The electric power supplied from the battery 120 is converted into high-frequency electric power and supplied to the coil 170 by the transmitting circuit 169. As a result, in the printer 10, high-frequency radio waves radiated from the coil 170 are received by the coil 87, converted into charging voltage by the receiving circuit 89, and supplied to the battery 81 via the charging circuit 83, so that the battery 81 is charged. In both FIGS. 18 and 19, the printer 10 and the cassette 100 are driven with the battery 120. FIG. 19 illustrates wirelessly charging the battery 81 by the battery 120 in parallel with driving the printer 10 and the cassette 100 with the battery 120 as illustrated in FIG. 18. According to the printer 10, a charging-side circuit including the charging circuit 83 and the printer controller 22 supplied with electric power from the battery 120 are circuits independent of each other.

Figure 20:
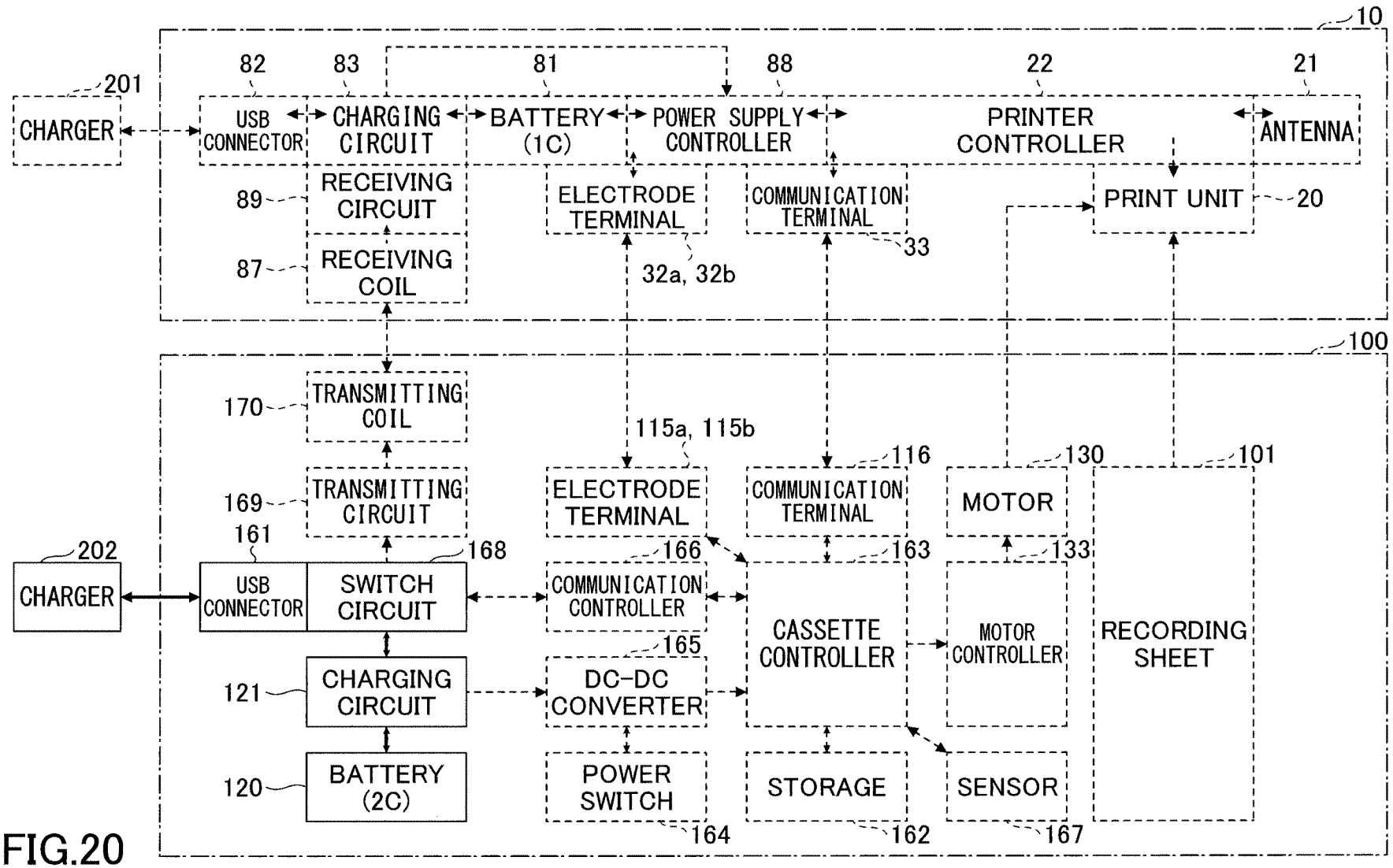

Charging of the battery 120 using the charger 202 is described with reference to FIG. 20. In this case, the power switch 164 is turned off, and the charger 202 is connected to the USB connector 161. Thereafter, electric power is supplied from the charger 202 to the battery 120 via the USB connector 161, the switch circuit 168, and the charging circuit 121, so that the battery 120 is charged.

According to this embodiment, when the printer 10 is turned on, an operating part provided in the printer 10 becomes operable. The printer 10 receives data from an information terminal using BLE to execute processing. When performing printing, the printer 10 starts print control to confirm the connection of a sheet cassette. At this point, the printer 10 determines whether the attached sheet cassette is the cassette 100 or the simplified cassette 900.

The feed roller of the cassette 900 is rotated by the rotation of the drive gear of the printer 10. Therefore, the printer controller 22 controls feeding of recording sheets from the cassette 900. Accordingly, when the cassette 900 is attached, the printer 10 performs an operation for conveying a recording sheet for a predetermined period of time. When the leading edge of the recording sheet is detected with a sensor of the printer 10, this information is transmitted to the printer controller 22. The printer controller 22 then proceeds directly to printing on the recording sheet. When no recording sheet is detected with the sensor, this information is transmitted to the printer controller 22. The printer controller 22 then determines the absence of a recording sheet and displays an indicator indicating the absence of a recording sheet to a user.

The feeding of a recording sheet from the cassette 100 is controlled by the cassette controller 163. Therefore, when the cassette 100 is attached, the printer 10 transmits a command to convey a recording sheet to the printer 10 using the motor 130 to the cassette controller 163. In response to the command from the printer 10, the cassette controller 163 performs an operation to feed a recording sheet.

The printer 10 determines whether print data in print command information received through BLE communication are stored in the internal memory of the printer 10 ("printer memory") or in the storage 162.

When the print data are stored in the printer memory, the printer controller 22 reads a file stored in the printer memory.

When the print data are stored in the storage 162, the cassette 100 transmits a file to the printer 10 via the communication terminals 33 and 116, so that the printer 10 performs printing.

When storing recorded data received from an information terminal through BLE communication in the storage 162, the printer 10 transmits the received data to the cassette 100 via the communication terminals 33 and 116 to store the received data in the storage 162. Examples of recorded data include character type fonts. The recorded data are stored in the storage 162 when not storable in the printer memory because of memory capacity.

When performing USB communications between an external information terminal and the cassette 100, the information terminal is connected to the USB connector 161. The cassette 100 can receive data from the information terminal and store the received data in the storage 162 independent of the printer 10 under the control of the cassette controller 163.

Although the one or more embodiments of the present invention have been described heretofore, the present invention is not limited to these embodiments, and various variations and modifications may be made without departing from the scope of the present invention.

What is claimed is:

1. A sheet cassette configured to store a recording sheet and connectable to a printer, the sheet cassette comprising:

a housing;

a battery provided in the housing;

a storage provided in the housing and configured to store information to be printed by the printer;

a communication terminal through which to perform communications between the sheet cassette and the printer;

an electrode terminal through which to supply electric power of the battery to the printer; and a control circuit provided in the housing and configured to transmit the stored information to be printed by the printer to the printer via the communication terminal based on a command received from a control circuit of the printer.

2. The sheet cassette as claimed in claim 1, further comprising:

a connector through which to perform communications with an information terminal, wherein the storage is configured to store information stored in the information terminal through the connector.

3. A printing system comprising:

a printer including a first control circuit; and a sheet cassette configured to store a recording sheet and connectable to the printer, the sheet cassette including a housing;

a second control circuit provided in the housing;

a battery provided in the housing;

a storage provided in the housing and configured to store information;

a communication terminal through which to perform communications between the sheet cassette and the printer; and an electrode terminal through which to supply electric power of the battery to the printer, wherein the second control circuit is configured to transmit the information stored in the storage to the printer via the communication terminal based on a command transmitted from the first control circuit to the second control circuit, and the printer is configured to print the information transmitted from the second control circuit on the recording sheet fed from the sheet cassette.

4. The printing system as claimed in claim 3, wherein the first control circuit is configured to control the second control circuit based on information received from an information terminal.

5. The printing system as claimed in claim 3, wherein the printer further includes another battery and a receiving coil, the sheet cassette further includes a transmitting coil, and the electric power of the battery is supplied to said another battery through the transmitting coil and the receiving coil to charge said another battery.

6. The sheet cassette as claimed in claim 1, wherein the information stored in the storage is image data to be printed by the printer.

7. The printing system as claimed in claim 3, wherein the information stored in the storage is image data, and the printer is configured to print the image data on the recording sheet fed from the sheet cassette.

* * * * *